US010309069B1

(12) United States Patent
Smith

(10) Patent No.: US 10,309,069 B1
(45) Date of Patent: Jun. 4, 2019

(54) STREET SWEEPER

(71) Applicant: Keith E Smith, Kathleen, FL (US)

(72) Inventor: Keith E Smith, Kathleen, FL (US)

( * ) Notice: Subject to any disclaimer, the term of this patent is extended or adjusted under 35 U.S.C. 154(b) by 432 days.

(21) Appl. No.: 15/156,733

(22) Filed: May 17, 2016

Related U.S. Application Data

(60) Provisional application No. 62/164,665, filed on May 21, 2015.

(51) Int. Cl.
*E01H 1/04* (2006.01)

(52) U.S. Cl.
CPC ..... *E01H 1/047* (2013.01); *E01H 1/045* (2013.01)

(58) Field of Classification Search
CPC ..... E01H 1/047; E01H 1/045; E01H 1/04; E01H 1/02
USPC ..... 15/75, 78, 82, 83
See application file for complete search history.

(56) References Cited

U.S. PATENT DOCUMENTS 2,684,496 A * 7/1954 Lull ..... E01H 1/047 15/83
3,186,015 A * 6/1965 Beyerstedt ..... E01H 1/047 15/84
3,938,212 A * 2/1976 Krier ..... A47L 11/30 15/50.3
4,037,284 A 7/1977 McDonald
4,236,756 A 12/1980 Hildebrand et al.
4,701,969 A 10/1987 Berfield et al.
5,054,150 A * 10/1991 Best ..... A47L 11/282 15/340.4
5,377,376 A * 1/1995 Wood ..... A47L 11/283 15/340.4
6,041,464 A * 3/2000 Ebersole ..... E01H 1/056 15/246
6,154,911 A 12/2000 Vanderlinden
6,687,939 B1 2/2004 Koester
7,428,767 B2 9/2008 Lougheed
2004/0045110 A1* 3/2004 Wilmo ..... E01H 1/045 15/82
2009/0083920 A1* 4/2009 Vanderlinden ..... E01H 1/045 15/83
2009/0119954 A1* 5/2009 Lemieux ..... E01H 5/068 37/236
2010/0325824 A1* 12/2010 Baum ..... A01K 1/01 15/87

FOREIGN PATENT DOCUMENTS

FR 2516566 A1 * 5/1983 ..... E01H 1/047
FR 2830550 A1 * 4/2003 ..... E01H 1/045
GB 2160091 A * 12/1985 ..... A47L 11/24

* cited by examiner

*Primary Examiner* — Joseph J Hail
*Assistant Examiner* — Timothy Brian Brady
(74) *Attorney, Agent, or Firm* — William M. Hobby, III

(57) ABSTRACT

An industrial street sweeper attachment removably attaches to a prime mover with a quick coupler and has a forward debris collecting hopper mounted on the front of a rotary brush compartment having a floating sweeping brush therein. The debris collecting hopper is hingedly attached to the brush compartment and has a linkage therebetween having a lifting arm and a lifting hydraulic cylinder which can remotely lock the debris collecting hopper to the brush compartment to receive swept debris from the rotary sweeping brush and can be remotely lifted to an open position for discharging debris.

14 Claims, 7 Drawing Sheets

STREET SWEEPER

This application claims the benefit of U.S. Provisional Application No. 62/164,665, filed May 21, 2015 for Street Sweeper.

FIELD OF THE INVENTION

This invention relates to an industrial street sweeper and especially to a street sweeper prime mover having a sweeper attachment that has a forward debris collection hopper coupled to a sweeper brush compartment with a floating sweeper brush and a coupler for coupling the sweeper attachment to the prime mover which allows for three dimensional movements between the sweeper attachment and a prime mover.

BACKGROUND OF THE INVENTION

Industrial sweepers used in cleaning streets and the like have a rotating brush mounted to the front or rear of a motorized vehicle. An electric or hydraulic motor drives the rotating brush or brushes along the surface of the area being cleaned, sweeping material into a bucket. The brush is controlled from the vehicle's cab with hydraulic or electric controls. The brush of the sweeper needs to be mounted in a position to sweep the area being traversed for cleaning the surface. This invention is for an industrial street sweeper and especially to a street sweeper having an attachment that has a forward dump hopper, a brush compartment and a coupler that allows for three dimensional movements between the sweeper and a prime mover.

One prior art U.S. Pat. No. 7,428,767 to Lougheed is for a sweeper which has a floating brush or drum assembly. A sweeper has a rotating brush or drum supported by a float arm movably coupled to the sweeper bucket. The float arm is coupled to a linkage to movably support the float arm between a retracted position and a forward position. The float arm is rotationally coupled to the linkage to compensate for height variations and provide a mechanism to rotate the linkage to move the float arm forward relative to the debris collection bucket.

Other U.S. Patents for street sweepers may be seen in the Hildebrand et al. U.S. Pat. No. 4,236,756 for a Street Sweeper having an Elevating Hopper with Supporting Outriggers and in the Koester U.S. Pat. No. 6,687,939 for a Bucket Sweeper. The McDonald U.S. Pat. No. 4,037,284 is for a Sweeper Assembly while the Vanderlinden U.S. Pat. No. 6,154,911 is for a Debris Lifting Apparatus for use in a Surface Sweeping Vehicle. The Berfield et al. U.S. Pat. No. 4,701,969 is for a Rotary Brush Sweeper with Easily Separable Debris Pan.

The present invention is for an improved industrial street sweeper sweeping attachment and especially to a street sweeper prime mover attachment that has a forward debris collection hopper coupled to a sweeper brush compartment and a coupler for coupling the sweeper attachment to the prime mover in a manner that allows for three dimensional movements between the sweeper attachment and a prime mover.

SUMMARY OF THE INVENTION

An industrial street sweeper attachment has a forward debris collecting hopper mounted to the front of a rotary brush compartment having a floating sweeping brush therein. The street sweeper attachment is removably attached to a pair of lifting arms of a prime mover with a quick coupling. The sweeper hopper is hingedly attached with top hinges to the brush compartment and is raised to an open position for discharging its contents and lowered into a locked position against the brush compartment for collecting debris from the sweeping brush by a pair of hydraulic cylinders each operating a hopper lifting arm. Each hopper lifting arm is a generally L-shaped arm that is connected to the brush compartment and through an adjustable link to said debris hopper to enable the hopper to be locked in a closed position against the brush compartment in a closed position.

An industrial street attachment is attached to a prime mover and has a forward debris collection hopper coupled to a sweeper brush compartment and a coupler for coupling the sweeper attachment to the prime mover. The street sweeper includes a prime mover having a pair of forward lifting arms to which the front mounted sweeper attachment is mounted to. The pair of lifting arms in front of the prime mover are adapted to be raised and lowered to raise and lower the sweeper attachment. The sweeper attachment has a brush compartment holding a floating rotatable sweeping brush therein and has a debris collecting hopper hingedly attached to the front thereof with a plurality of top mounted hinges. The sweeper attachment has a pair of lifting cylinders each attached through an adjustable linkage to the debris collecting hopper to rotate said hinged debris hopper relative to the brush compartment. The hopper lifting arm is a generally L-shaped arm which connects over the center of the debris hopper through an adjustable linkage. Each hydraulic cylinder moves a hopper lifting arm to lock the hopper to the brush compartment when in a closed position against the brush compartment for collecting debris being swept up by the sweeping brush. The debris collecting hopper closed position has an open side aligned with the front of the brush compartment for receiving debris swept up by the rotating brush and an open position for dumping collected debris therefrom when the sweeper attachment is raised by the prime mover lifting arms. The brush compartment has the rotating brush supported therein by a pair of lever arms, one on each end of a shaft with each arm riding in an arcuate track and supported to the brush compartment with a spring to allow the brush to float. A chain attached between the brush compartment and each lever arm limits the drop of the brush when the sweeper attachment is raised for dumping the debris hopper. Both the brush compartment and the debris hopper have skids with removal pads. The hopper also has a pair of wheels.

BRIEF DESCRIPTION OF THE DRAWINGS

The accompanying drawings, which are included to provide further understanding of the invention, are incorporated in and constitute a part of the specification and illustrate an embodiment of the invention and together with the description serve to explain the principles of the invention.

DETAILED DESCRIPTION OF EXEMPLARY EMBODIMENT

Figure 1:
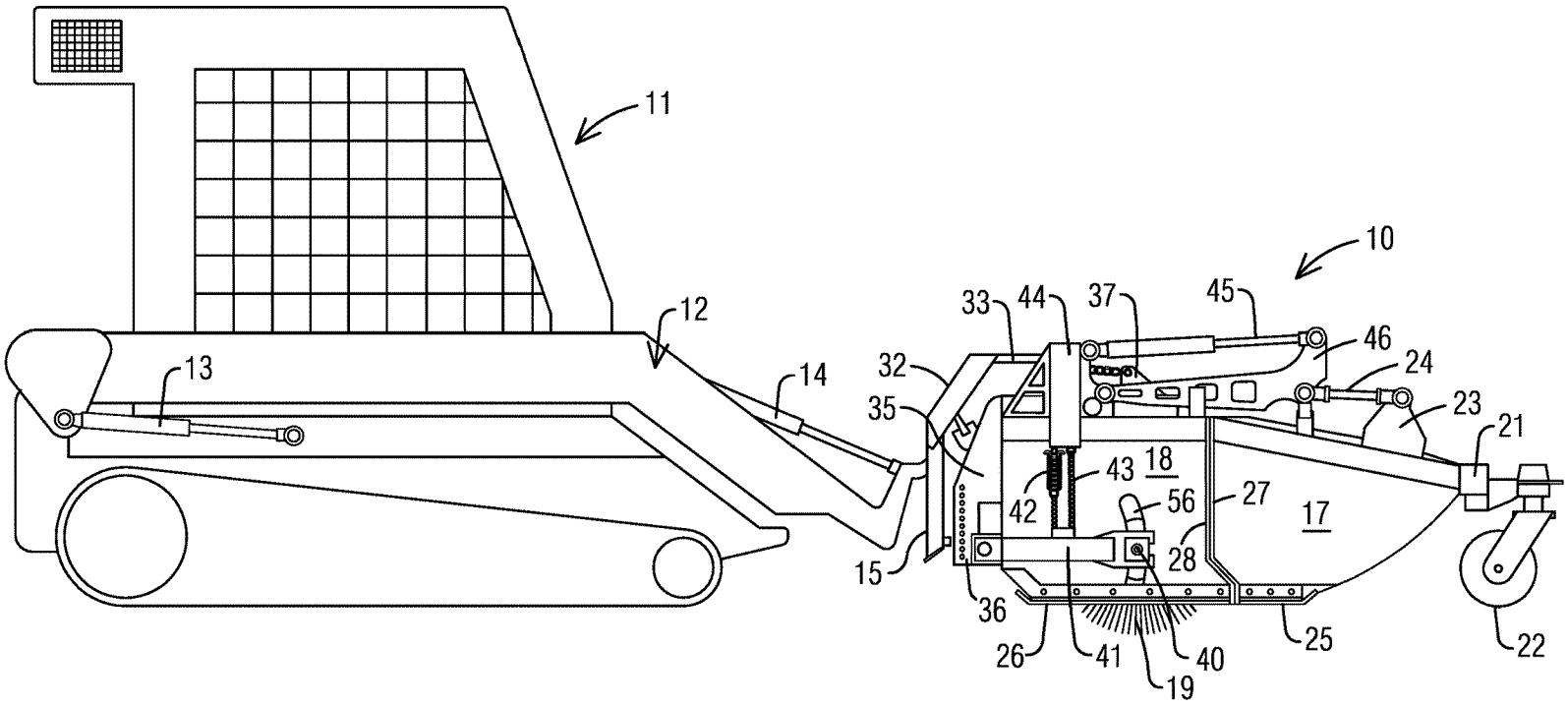
FIG. 1 is a side elevation of a street sweeper in accordance with the present invention.
Figure 2:
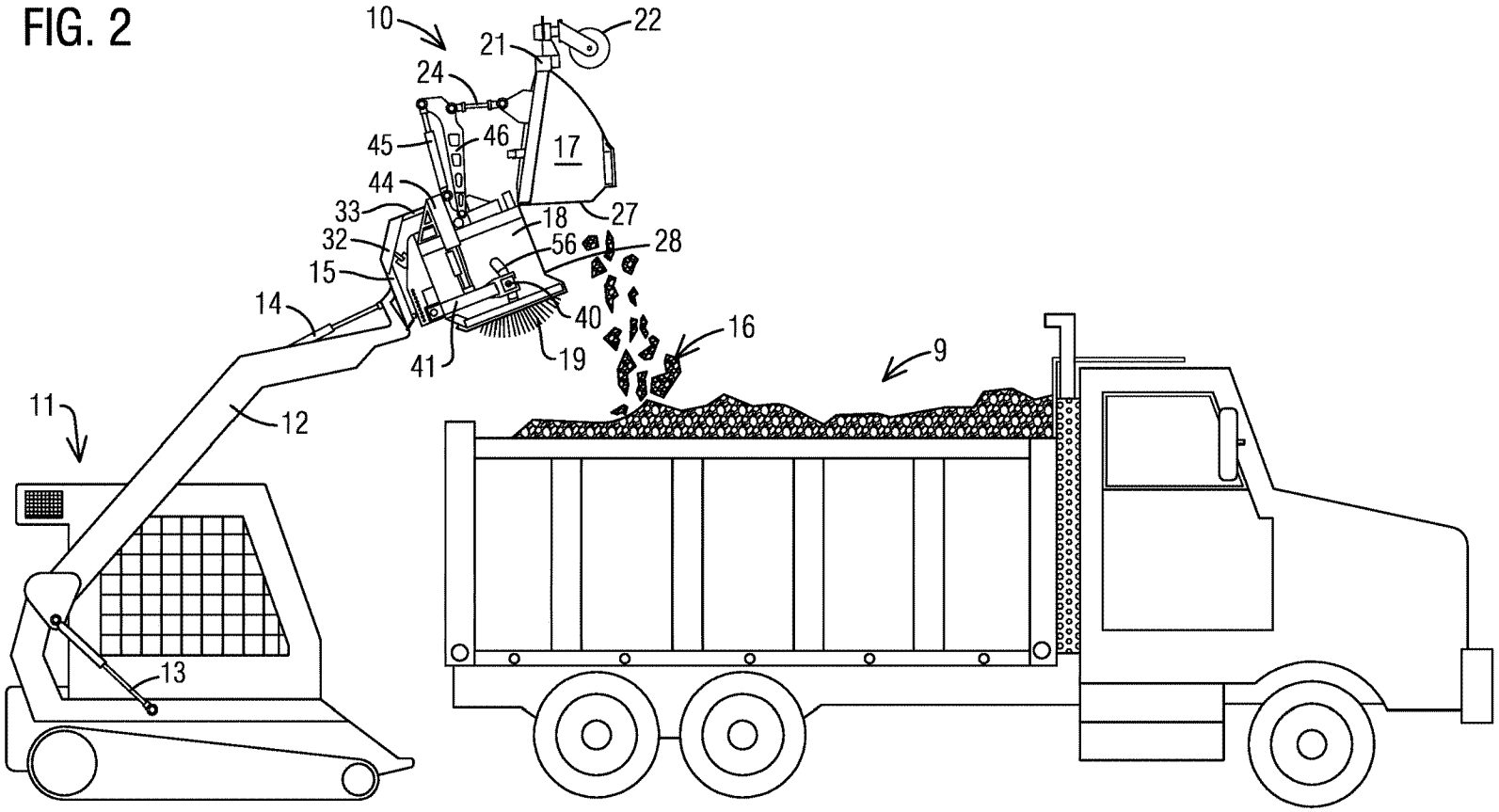
FIG. 2 is a side elevation of the street sweeper in accordance with claim 1 dumping a load of debris into a dump truck.
Figure 3:
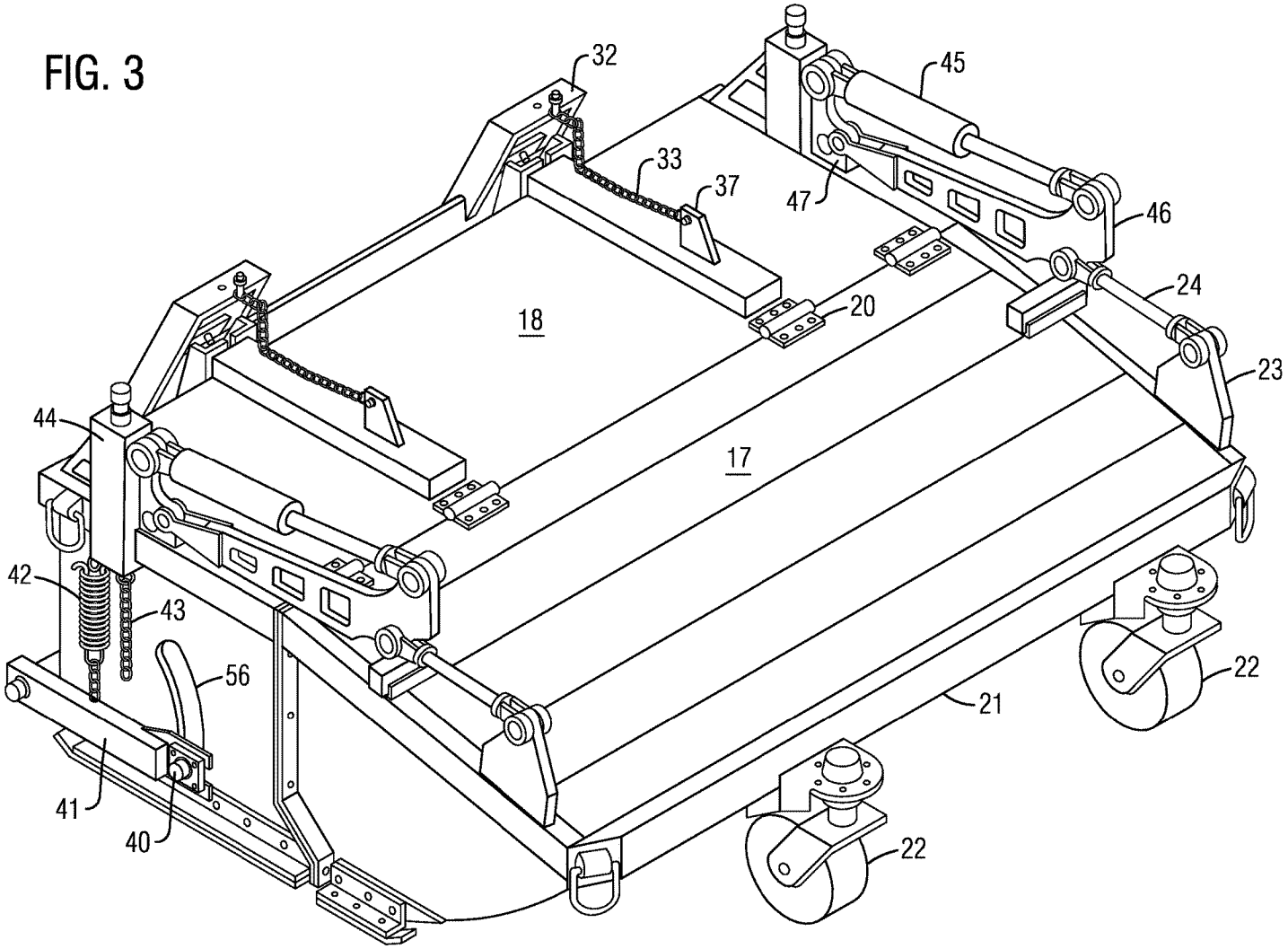
FIG. 3 is a front perspective view of the street sweeper attachment of FIGS. 1 and 2.
Figure 4:
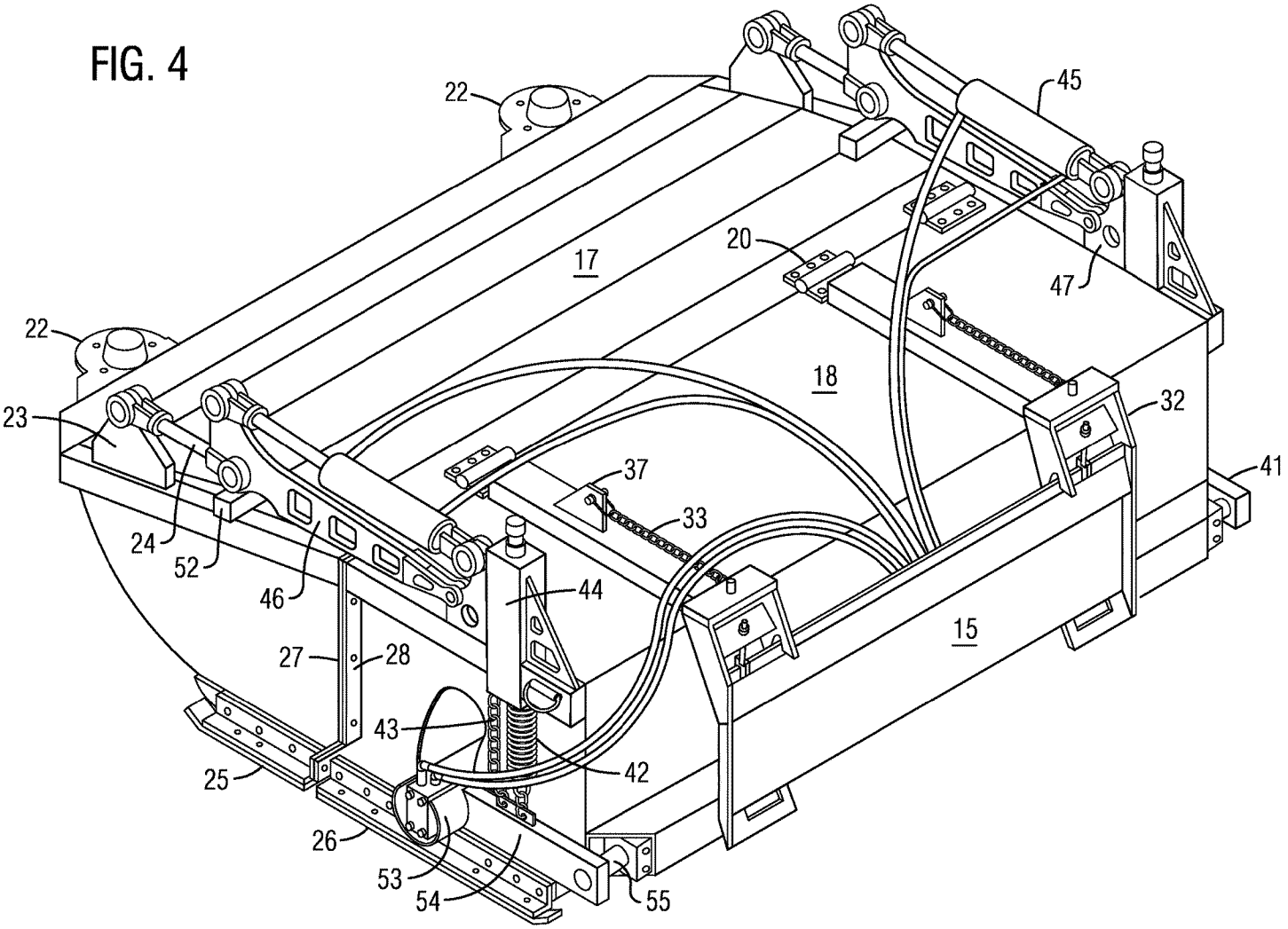
FIG. 4 is a rear perspective view of the street sweeper attachment of FIGS. 1-3.
Figure 5:
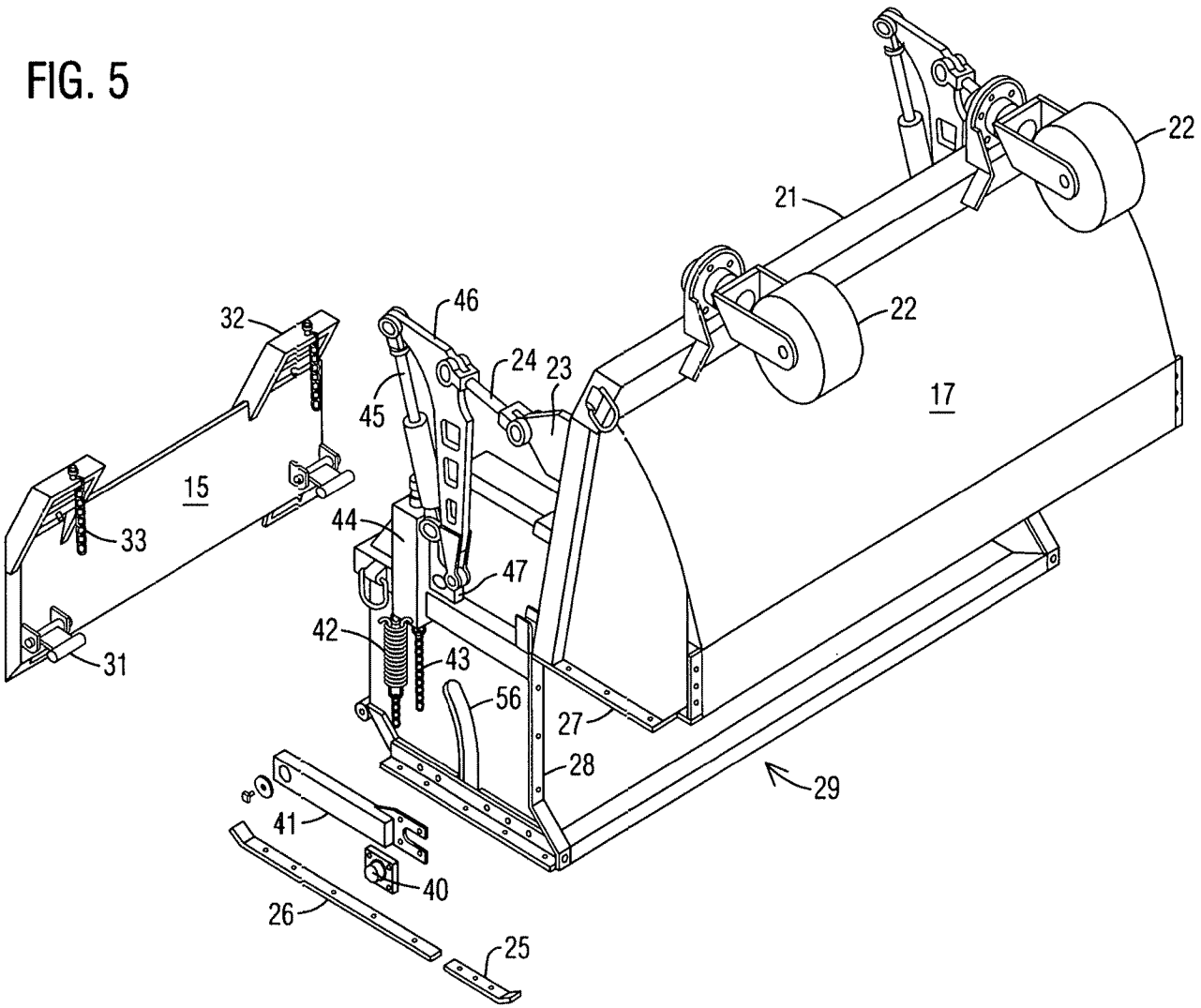
FIG. 5 is a partial exploded perspective of the street sweeper attachment with the pan in a raised position.

The present invention is for an industrial sweeper machine, as shown in the FIGS. 1 and 2. A sweeper attachment 10 is shown attached to the front of a prime mover 11 pair of lifting arms 12 which are actuated by a pair of lifting hydraulic cylinders 13 along with a pair of hydraulic cylinders 14. The prime mover lifting arms 12 connect to a quick coupler plate 15 for lifting the front sweeper attachment 10 and dumping collected debris 16 into a dump truck 9 as shown in FIG. 2.

The sweeper attachment has a forward debris hopper 17 hingedly attached to a brush housing 18. The sweeper machine is shown in FIG. 1 in an operative sweeping position and in FIG. 2 with the forward debris hopper 17 being dumped into the truck 9.

As seen in the drawings, FIGS. 1-7, this invention is for an industrial sweeper attachment 10 that has a forward debris hopper 17 and a brush compartment 18 and is coupled to the prime mover 11 in a manner that allows for three dimensional movements between the sweeper attachment 10 and the prime mover 11. The sweeper attachment 10 has a plurality of top hinges 20 that connects the forward debris hopper 17 to the brush compartment 18. This allows the forward debris hopper 17 to be emptied as shown in FIG. 2.

The sweeper attachment 10 consists of three main components: a debris hopper 17, a brush compartment 18 and a quick coupler plate 15. The debris hopper 17 connects to the brush compartment 18, having the rotating brush 19 therein. The hinge 20 allows the hopper 17 to be rotated upward to allow the debris being swept from a road or other surface to exit the debris hopper 17. The debris hopper 17 has a brush compartment support 21 with caster wheels 22, which are necessary in order to keep the hopper 17 from dragging on the surface being swept. The forward support structure increases the strength of the debris hopper 17 in this location to enable the attachment of the adjustable lift linkage 23 having an adjustable link 24. The adjustable linkage is used in the lifting, dumping, closing, and locking process. A replaceable forward skid plate 25 on the bottom of the debris hopper 17 and a rear skid plate 26 on the bottom of the brush compartment 18 protect the bottom of the debris hopper 17 and brush compartment 18.

During the opening and closing process between the debris hopper 17 and the brush compartment 18, a sufficient amount of pressure by the locking mechanism is exerted when the hopper 17 and compartment 18 meet so that a contact surface is needed. This is accomplished by the debris hopper 17 contact support structure 27 and the hinged brush compartment 18 contact support structure 28. When the hopper contact support structure 27 and the brush contact support structure meet, they form a seal between the debris hopper 17 and brush compartment 18. The brush compartment 18 houses the brush 19 and the means to attach the necessary component to complete the sweeping attachment 10.

The brush compartment 18 has a main support beam 30 and a brush compartment support 21 that each span side to side to give support to the sides of the brush compartment 18 and debris hopper 17. A side to side debris deflector 29 acts as a deflector to deflect debris being swept to skip over in order to fill the forward section of the debris hopper 17. Debris deflector 29 also mates against the debris hopper to create a seal between the hopper 17 and the brush frame 18.

The sweeper attachment 10 is attached to the prime mover in a manner to allow the sweeper and prime mover to move independent of each other. This is accomplished by the use of the quick coupler plate 15 and vertical and horizontal chain lifting support 32 having the horizontal lift chains 33 and vertical lift chains 34 attached thereto. The vertical chain 34 is attached at the other end to the main link height adjustment bracket 35 having the vertical chain adjustment holes 36. The horizontal chain 33 is attached at the other end to the top support lifting arm 37. The quick coupler plate 15 provides the means to adapt or couple to different prime movers.

The ability to raise or lower the rear portion of the sweeper attachment 10 is essential to the sweeping process. The height of the rear portion of the sweeper needs to be adjusted for different heights of the prime movers lifting arms 12. The rear portion of the sweeper 10 is adjusted to a prescribed height from the surface being swept. The rear skid shoes 26 would wear out prematurely without the ability to make this adjustment thus creating the need to be able to change the skid shoes 26.

The brush 19 has an idle arm bearing 40 on each end thereof which is held by a brush frame idle arm 41 which allows the bearings 40 to move in an arcuate track and thereby float or allow movement of the brush 19. The brush frame swinging arm 41 is held by a spring 42 and a chain 43 which are connected between the swinging arm 41 and a brush height adjustment support structure 44.

The dumping process is achieved with a pair of lift hydraulic cylinders 45, each attached at one end to an L-shaped lifting arm 46 and to the rear cylinder and L-shaped bracket attachment riser 47 on the other end which is in turn attached to the brush compartment 18. An adjustable link 24 is connected between the L-shaped hopper lifting arm 46 on one end and to the adjustable link attachment riser 23 on its other end. Actuation of the hydraulic cylinder 45 will act to pull the hopper 17 to rotate the hopper on the hinges 20 to a position as shown in FIG. 2 for dumping a load of debris 16 into the dump truck 9.

The movement of the lift cylinder 45 with an in and out motion raises and lowers the L-shaped lifting arm 46 at a point located below the cylinder connection point. The adjustable lifting link 24 is connected to the adjustable link attachment riser 23. The in and out motion of the lift cylinder 45 raises and lowers the debris hopper 17 in relation to the brush compartment 18.

The debris hopper needs to be locked shut to prevent it from opening prematurely and causing spillage of the debris therein and to prevent the rubbing of the forward skid shoes 25 and rear skid shoes 26 against the surface being swept when the lift cylinder 45 is extended pushing the L-shaped lifting arm 46 downward. Once an over-the-center connection is achieved, the hopper is locked mechanically and will only re-open by the lift cylinder 45 to lift the debris hopper 17. A stop for over the center linkage or arm support guide and locking mechanism 52 is provided to stop the movement downward of the lift cylinder 45, the L-shaped hopper lifting arm 46 to lock the debris hopper 17 shut and hold it shut tightly.

Figure 6:
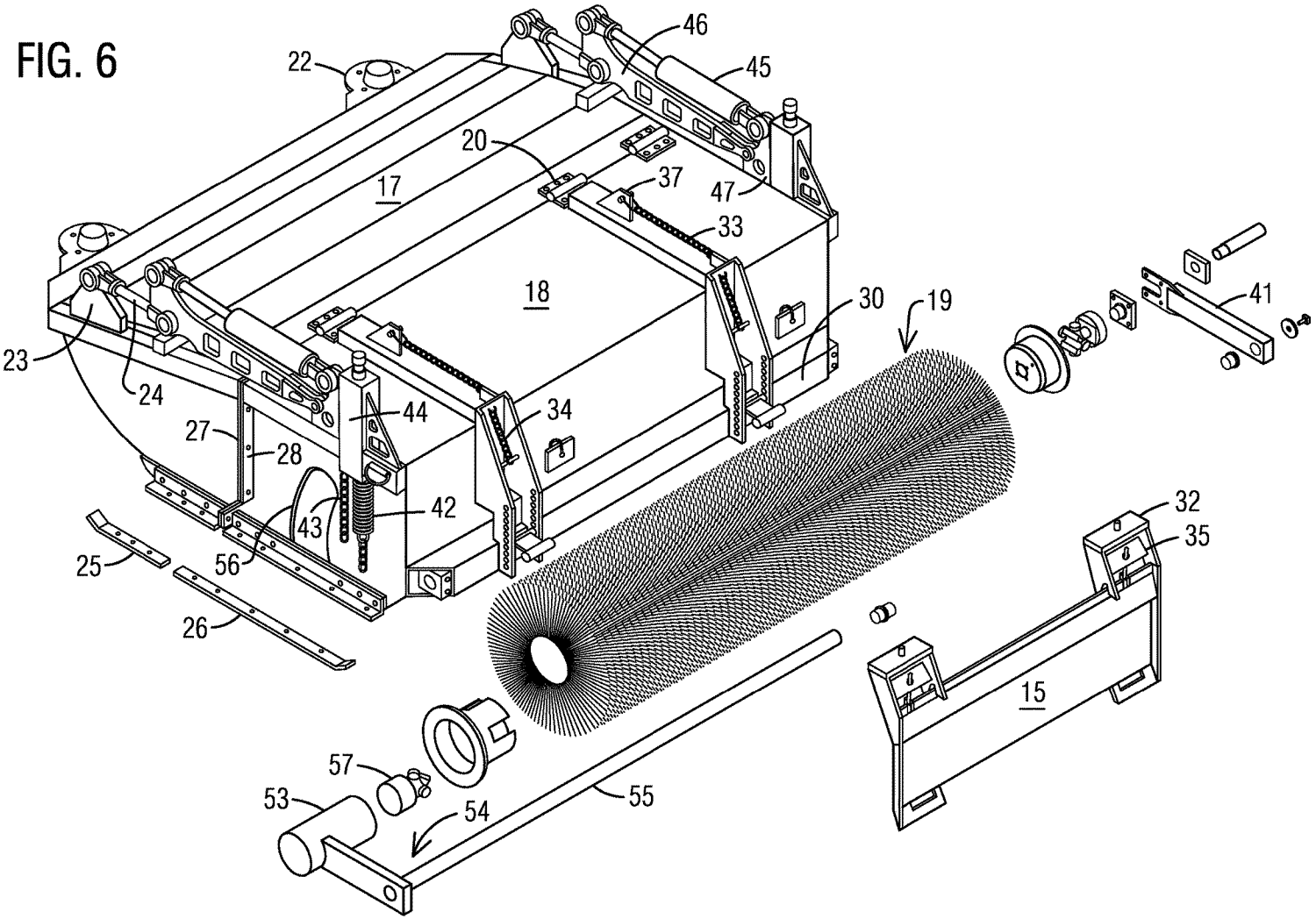
FIG. 6 is a partial exploded perspective of the street sweeper attachment showing the sweeper brush removed.
Figure 7:
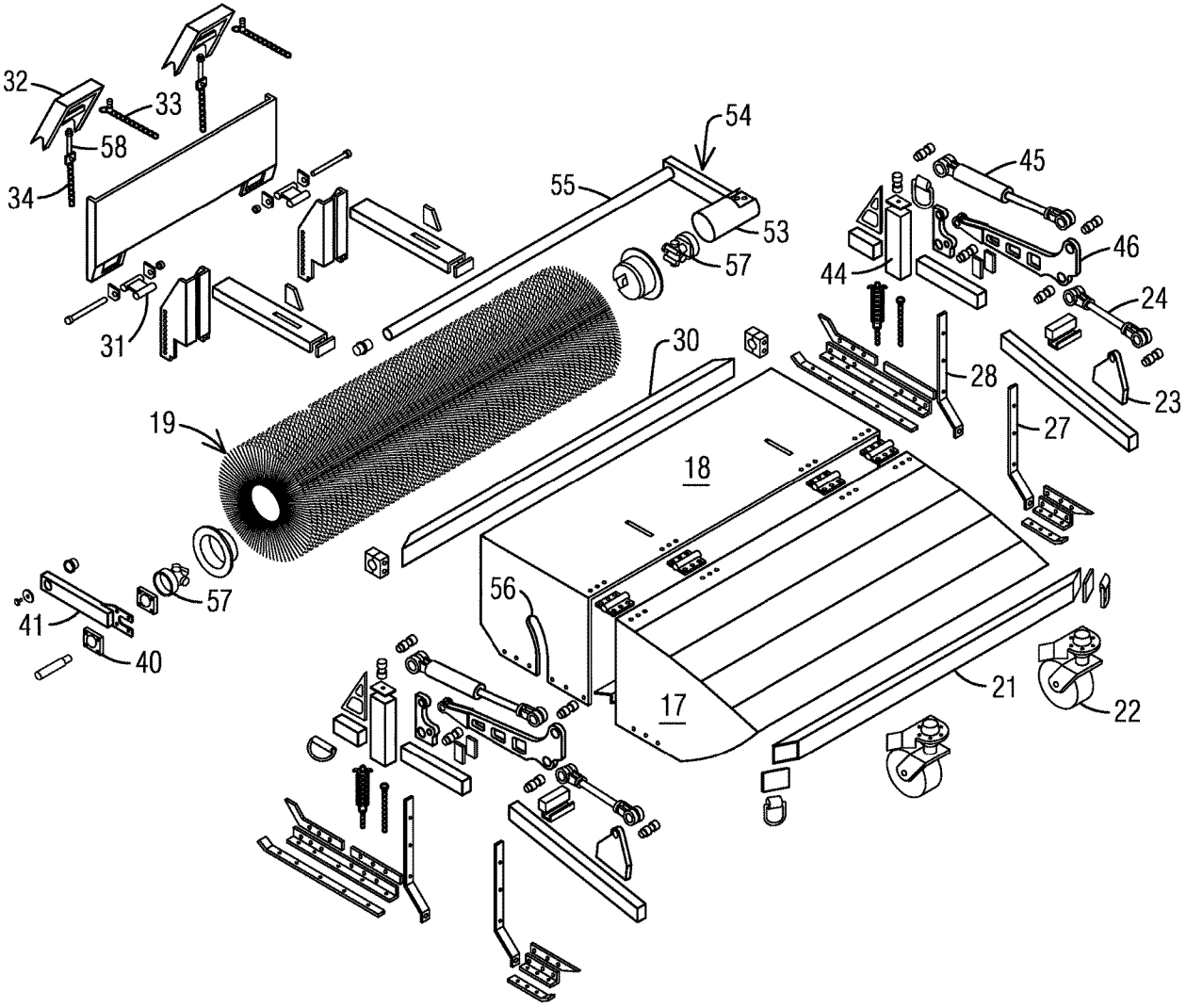
FIG. 7 is an exploded perspective of the street sweeper attachment.

A frame structure supports a rotary brush 19 with a brush frame L-shaped motor arm 54 which has a hydraulic or electric motor 53 for driving the brush 19. The brush frame L-shaped motor arm 54 allows for adjustment in a vertical direction. As can be seen in FIG. 6, the brush 19 is supported between the brush frame L-shaped motor arm 54 on one end and with the brush frame idler arm 41 on the other end. The shaft 55 of the hydraulic motor of the L-shaped motor arm 54 is held in place in the brush frame and is connected to the swinging arm 41 which allows the brush 19 to move in a vertical direction while allowing the brush to rotate on bearings. A bearing 40 is mounted to each end of the support brush 19. The hydraulic motor 53 has the ability to move in a vertical direction as the brush 19 rides on bearings 40 riding in a slot 56 in each side of the brush compartment 18. The L-shaped motor arm 54 provides a means to mount a hydraulic brush motor 53. A universal joint 57 attaches to the brush shaft on either end thereof.

The vertical adjustment of the brush frame is accomplished by the use of the brush height adjustment support structure 44 which has a brush height adjustment nut to adjust the brush height adjustment chain 43.

The vertical chain 34 attaches to the main link height adjustment bracket 35 by means of a bolt for making vertical coarse adjustments and to the vertical adjustment bracket 32. The vertical chain 34 attaches to the vertical chain fine adjustment bolt 58 to the vertical and horizontal chain lifting support 32. The bolt 58 passes through the vertical and horizontal chain lifting support 32 which allows the attachment to be set at the proper height from the surface being swept.

The horizontal chain 33 provides a flexible connection between the brush compartment 18 and the quick coupler 15. The horizontal chain 33 connects to the brush compartment 18 to the top support lifting arm 37. The horizontal chain 33 attaches to the quick coupler 15 by means of the vertical and horizontal chain lifting support 32.

The ability to raise or lower the rear portion of the sweeper attachment 10 is essential to the sweeping process. The height of the rear portion of the sweeper needs to be adjusted for different heights of the prime movers lifting arms 12. The rear portion of the sweeper 10 is adjusted to a prescribed height from the surface being swept. The rear skid shoes 26 would wear out prematurely without the ability to make this adjustment.

Operation of the street sweeper attachment 10 uses linkage comprising of a L-shaped lifting arm and an adjustable connecting linkage 24 that connects at a pivotal point on the debris hopper 17 and a pivotal point on the brush compartment 18. A pair of hydraulic cylinders 45 provide means to lift the debris hopper 17 in a upward position allowing for debris to be dumped therefrom, as shown in FIG. 2. The sweeper attachment 10 is connected to the prime mover 11 by means of a quick coupler mechanism that is connected to the sweeper by a linkage 31 at the bottom of the brush compartment 18. A horizontal chain 33 and a vertical chain 34 allow the sweeper 10 to be lifted and to move independent in a three-dimensional manner. The lifting linkage described has the ability to lock the sweeper 10 shut in over the center positioning by using three pivot points that allows the center pivot point to drop below a straight-line position of the forward pivot point in relation to the rear pivot point. The brush compartment 18 has means to adjust the downward force of the brush to the surface being swept. The brush compartment 18 has means for a brush frame to rotate allowing the brush to move vertically. The brush compartment 18 also has means to connect a forward and reverse motion linkage that allows the prime mover to push or pull the sweeper 10. The brush compartment 18 has means to attach a vertical lifting chain 34. The brush compartment 18 also attaches a horizontal lifting chain 33. The coupling mechanism attaches a push pull linkage, the horizontal chains and the vertical chains in a coupler device for attaching to a prime mover 11.

The sweeping attachment 10 provides advantages over existing sweepers on the market today. It has a forward sweeping direction making it much safer than existing machines on the market today that require a reverse motion of the prime mover to achieve a clean sweep. It also has means to adjust the contact pressure of the brush and means to move the sweeper attachment 10 independent of the prime mover 11 in a three-dimensional manner. The sweeper attachment 10 lifts the debris hopper 17 in an upward manner.

It should be clear at this time that an industrial street sweeper system has been provided which has a forward debris collection hopper positioned in front of a prime mover adjacent a front rotary sweeping brush. However the present invention is not to be considered limited to the forms shown which are to be considered illustrative rather than restrictive.

I claim:

1. A street sweeper comprising:

a prime mover having a pair of prime mover lifting arms;

a front mounted sweeper attachment mounted to said pair of prime mover lifting arms in front of said prime mover and adapted to be raised and lowered by said prime mover lifting arms;

said sweeper attachment having a brush compartment holding a rotatable sweeping brush therein and a debris collecting hopper hingedly attached to the front of said brush compartment, said debris collecting hopper having a contact support structure aligned with a brush compartment support structure to form a seal between the debris collection hopper and the brush compartment when the debris hopper is in a closed position and said sweeper attachment having a hopper lifting arm having two ends movably attached to said brush compartment at one end thereof and to said debris collecting hopper at the other end thereof, and the sweeper attachment having a hopper lifting hydraulic cylinder attached between said brush compartment and said hopper lifting arm at a point over said debris collecting hopper for raising and lowering said debris collecting hopper and for locking said debris collecting hopper in a closed position by actuation of said hopper lifting hydraulic cylinder with said debris collecting hopper open side aligned with the front of said brush compartment for receiving debris swept up by said brush and said debris collecting hopper adapted to be raised by actuation of said hopper lifting hydraulic cylinder to an open position for dumping the contents therefrom when said sweeper attachment is raised by said prime mover lifting arms;

wherein said front mounted sweeper attachment debris collecting hopper can be held to said brush compartment by said hopper lifting hydraulic cylinder for receiving debris swept up by said brush and remotely opened when said sweeper attachment is raised by said pair of prime mover lifting arms to dump collected debris therefrom.

2. The street sweeper in accordance with claim 1 having an adjustment linkage connecting said hopper lifting arm to said debris collecting hopper for adjusting the connection of said hopper lifting arm to said debris collecting hopper.

3. The street sweeper in accordance with claim 2 in which said hopper lifting arm is a generally L-shaped arm having said hopper lifting hydraulic cylinder attached to the other end thereof at the end of an upward extending leg of said generally L-shaped arm.

4. The street sweeper in accordance with claim 3 in which each side of said brush compartment has one said hopper lifting hydraulic cylinder attached between said brush compartment and one said hopper lifting arms.

5. The street sweeper in accordance with claim 1 in which said brush compartment has one said rotatable sweeping brush is a floating brush supported by a pair of swinging arms, one on each end thereof.

6. The street sweeper in accordance with claim in which said brush compartment rotatable sweeping brush supporting swinging arms are each attached to a rotatable shaft.

7. The street sweeper in accordance with claim 6 in which one of said brush compartment rotatable sweeping brush supporting swinging arms has a brush motor attached thereto for driving said brush.

8. The street sweeper in accordance with claim 7 in which each of said brush compartment rotatable sweeping brush supporting swinging arms has a spring attached thereto and to said brush compartment allowing said rotatable brush to float along a surface being cleaned.

9. The street sweeper in accordance with claim 8 in which each of said brush compartment rotatable sweeping brush supporting swinging arms has a limiting chain attached thereto and to said brush compartment allowing limiting said rotatable sweeper brush vertical movement when lifting said sweeper attachment to dump said debris hopper.

10. The street sweeper in accordance with claim in which said brush compartment has a pair of skids thereon supporting said brush compartment when on a surface.

11. The street sweeper in accordance with claim in which said debris hopper has a pair of skids thereon supporting said debris hopper when on a surface.

12. The street sweeper in accordance with claim 1 in which said debris collecting hopper has a pair of wheels on the front thereof.

13. The street sweeper in accordance with claim 1 in which said brush compartment has a quick change coupling having a vertical adjustment linkage having a height adjustment chain connected between said sweeper attachment quick change coupler and said brush compartment.

14. The street sweeper in accordance with claim 13 in which said brush compartment has a quick change coupling having a horizontal adjustment linkage having a horizontal adjustment chain connected between said sweeper attachment quick change coupling and the brush compartment.

* * * * *